US005927495A

United States Patent [19]

Didiano, Jr.

[11] Patent Number: 5,927,495

[45] Date of Patent: Jul. 27, 1999

[54] MAILER BOX PRODUCT

[75] Inventor: Frederick Didiano, Jr., Westlake, Ohio

[73] Assignee: Manco, Inc., Avon, Ohio

[21] Appl. No.: 08/879,881

[22] Filed: Jun. 20, 1997

[51] Int. Cl.[6] ..... B65D 85/00

[52] U.S. Cl. ..... 206/459.5; 206/806; 206/831; 229/92.8; 229/921

[58] Field of Search ..... 206/459.5, 806, 206/813, 831, 466, 467, 468, 469, 470, 471; 383/78, 87; 229/92.8, 921

[56] References Cited

U.S. PATENT DOCUMENTS

| | | | |
|---|---|---|---|
| 2,861,735 | 11/1958 | Faltin | 229/53 |
| 3,286,905 | 11/1966 | Farukhi | 229/9 |
| 3,458,037 | 7/1969 | Larson | 206/78 |
| 3,946,936 | 3/1976 | Brown | 206/806 |
| 4,108,350 | 8/1978 | Forbes, Jr. | 229/27 |
| 4,166,532 | 9/1979 | Tsuchida et al. | 206/333 |
| 4,184,308 | 1/1980 | Sharp | 53/413 |
| 4,291,807 | 9/1981 | Glordano et al. | 206/806 |
| 4,360,106 | 11/1982 | Irivine et al. | 206/621 |
| 4,378,903 | 4/1983 | Sherwood | 229/6 |
| 4,899,882 | 2/1990 | Benner | 206/470 |
| 5,499,713 | 3/1996 | Huffer | 206/813 |
| 5,617,656 | 4/1997 | Ludlow et al. | 40/299 |

OTHER PUBLICATIONS

Cardstuff™ product of American Greetings Corp., Cleveland, Ohio 44144.

*Primary Examiner*—Paul T. Sewell
*Assistant Examiner*—John Preta
*Attorney, Agent, or Firm*—Vickers, Daniels & Young

[57] ABSTRACT

A mailer product is described which can be sold free of external packaging thus allowing single unit quantities to be sold at a reasonable price. The product is provided with a separable merchandiser panel containing desired merchandising information connected to the product at a perforated line with notches at each end for ease of separation. A vertical extension on one side of the merchandiser panel allows merchandising information to be provided above merchandising hook level in an area heretofore wasted.

1 Claim, 3 Drawing Sheets

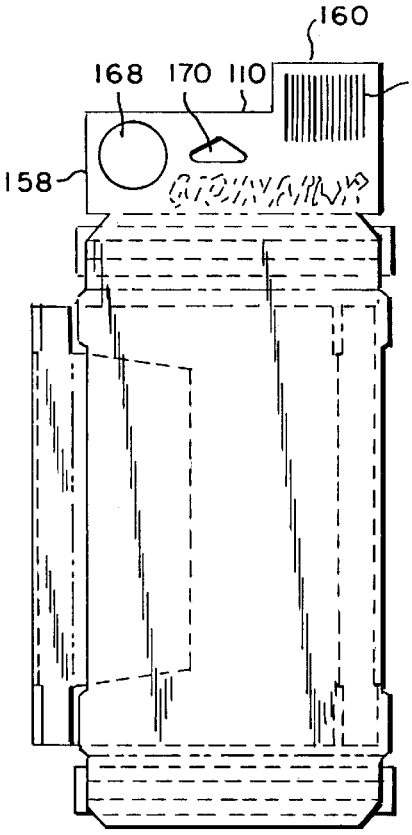
FIG. 5
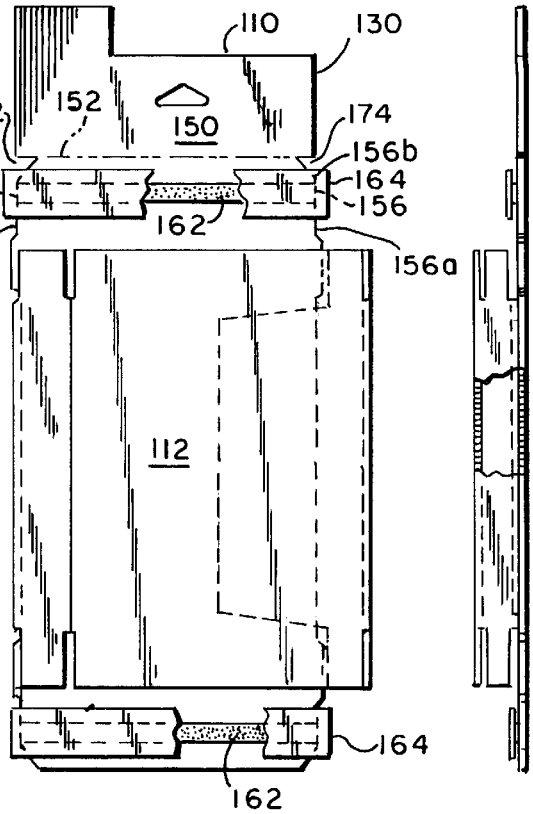
FIG. 6
FIG. 7
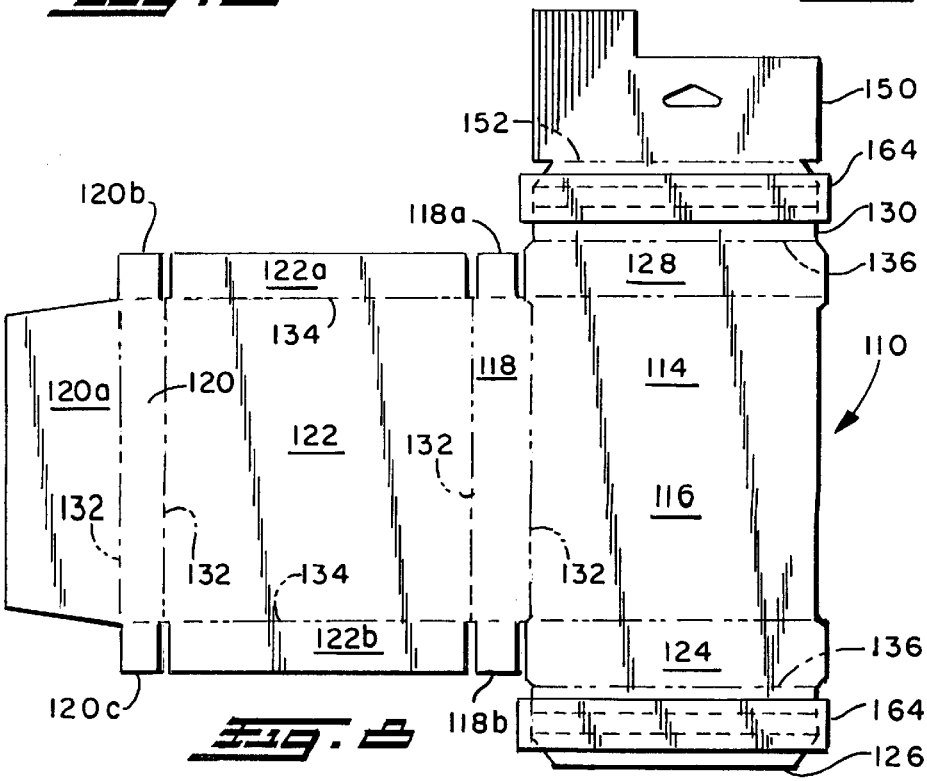
FIG. 8

MAILER BOX PRODUCT

FIELD OF THE INVENTION

The present invention relates to a mailer product which can be merchandised without the need for external packaging and more particularly to a mailer box product fabricated from a single piece cardboard with a separable merchandiser panel.

BACKGROUND OF THE INVENTION

Businesses, families and individuals often ship photographs, compact discs, floppy disks, video tapes, and other small items. Many of these items are easily damaged by folding or the like encountered in shipping. Therefore, the shipper will package the item in a box made from cardboard or the like. Business organizations which do a large volume of shipping purchase mailing containers specifically sized to accommodate compact discs, floppy disks and the like. Such containers come in cartons containing a number of mailing containers. Individuals who do not mail photos or compact discs often enough to justify buying numerous containers, usually proceed otherwise. Compact discs may be mailed in padded envelopes which do not provide the protection one gets from a box. Otherwise, an individual may use a large box found around the house stuffed with crumpled newspaper. This increases mailing costs. This approach also does not provide maximum protection for the items being shipped.

Dedicated packaging for shipping as described above is sold as a product. Usually several packages are contained within a carton or other container upon which required product information can be placed. Thus, when one sells a product one must put the product identity on the container, put the distributor's name on the container, apply a UPC bar code for use at retail and otherwise identify the product being sold. It is desirable to have this information on the packaging for the product, not on the product itself. This is true for mailing cartons and also holds true for gift packages and the like. In both instances, the shipper or gift giver will want his name or the name of the recipient to be on the product not the name of the person who made or distributed the product. In mailing and shipping, the post office and some commercial shippers apply bar codes to the package for use in routing. The presence of a UPC bar code used in retail would then result in two bar codes, one used only in retailing and one used in routing on the package.

In the past, when shipping products have been packaged for consumer use, the product count in a particular container is kept low. The normal consumer does not wish to buy 10 shipping containers when he only intends to use one or two. He will simply have to throw away or store the other eight. Small product count per package increased costs. The cost of packaging could not be divided among a large number of products as is the case with commercial quantities of 10 or 20. Thus, the consumer price was higher to account for the high per unit packaging cost.

SUMMARY OF THE INVENTION

To overcome these problems, the present invention comprises a container product having a merchandising panel integrally connected but separable from the container product.

Further in accordance with the invention, there is provided a container product comprising a box with a top panel, a top flap and a merchandiser panel all connected to one another and extending away from the main body of the box. The merchandiser panel bears product information including a UPC code and is separable from the top flap at a straight line.

Yet further in accordance with the invention, the straight line between the merchandiser panel and the top flap is scored.

Still further in accordance with the invention, the line between the merchandiser panel and the top flap is perforated.

Yet further in accordance with the invention, the line between the merchandiser panel and the top flap is scored and perforated allowing easy clean separation of the merchandising panel from the remaining portions of the product.

Still further in accordance with the invention, the top flap is provided with a band of adhesive covered with a parting sheet allowing the consumer to easily and securely close the box product once the merchandiser panel is removed and the intended contents inserted in the package.

Yet further in accordance with the present invention, the merchandising panel is provided with a hole allowing the product to be displayed on standard merchandising pegs and a portion of the merchandiser panel to one side is of increased height whereby additional merchandising information display area is provided.

It is a primary object of the present invention to provide a box product which can be marketed individually to consumers without the need of additional packaging for use in retailing.

It is another object of the present invention to provide a packaging product which can be sold inexpensively to consumers in single unit quantities.

It is still another object of the present invention to provide a packaging product which can be sold to consumers bearing printing and marking on the product appropriate for mailing, shipping or gift giving and bearing required retailing information on a merchandiser panel separable from the product whereby a pleasing product is easily and economically merchandised.

It is a further object of the present invention to provide packages which can be individually displayed and retailed in minimum space whereby retailers can offer a wide variety of package products to consumers at reasonable prices in single unit offerings.

These and other objects and advantages of the present invention will become apparent from the following detailed description when read in conjunction with the drawings which form a part hereof.

BRIEF DESCRIPTION OF THE DRAWINGS

FIG. 5 is a front plan view of a compact disc mailer in accordance with a second embodiment of the invention;

FIG. 6 is a rear plan view of the compact disc mailer of FIG. 5;

FIG. 7 is a side view of the compact disc mailer of FIGS. 5 and 6, partially in section;

FIG. 8 is a plan view of the compact disc mailer of FIGS. 5–7 completely unfolded;

DESCRIPTION OF PREFERRED EMBODIMENTS

Referring now in greater detail to the drawings, wherein the showings are for the purposes of illustrating preferred embodiments of the invention and not for the purpose of limiting the invention, FIGS. 1–4 show a photo mailer 10 fabricated from corrugated cardboard. In the preferred embodiment, the corrugated cardboard is about 1/16" (1.5 mm) thick and has a finished surface 12 and a Kraft paper surface 14. The finished surface 12 is a paper with a finer surface than Kraft paper. The finished surface 12 is a more uniform and easily printed surface and can be a color and pattern selected to please a consumer. While the Kraft paper surface 14 can also be printed, it will not be as attractive as the finish surface 12 and is less expensive.

The photo mailer 10 is fabricated from a single piece of corrugated cardboard by die cutting or the like. The photo mailer 10 is manufactured by die cutting, scoring, perforating, and printing the corrugated cardboard while it is still unfolded. This allows all of these operations to be performed on high speed presses such as web presses to minimize manufacturing costs. Bands of adhesives are also applied while the photo mailer 10 is in the flat stage. Parting sheets are applied to the bands of adhesives as required.

Figure 2:
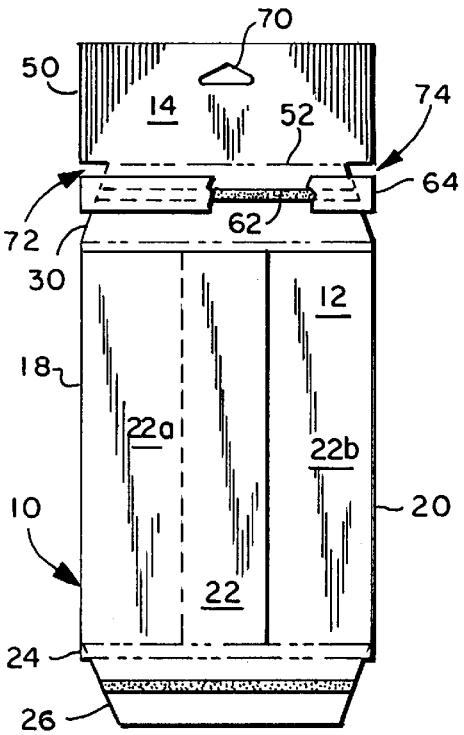
FIG. 2 is a plan view of the back of the photo mailer shown in FIG. 1 with the bottom flap in the unfolded down position.
Figure 3:
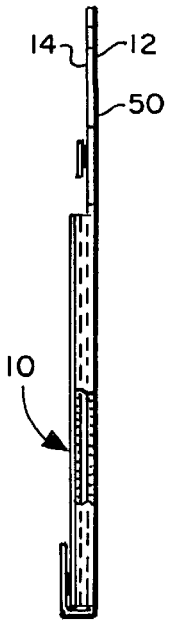
FIG. 3 is a side elevational view of the photo mailer seen in FIGS. 1 and 2.
Figure 4:
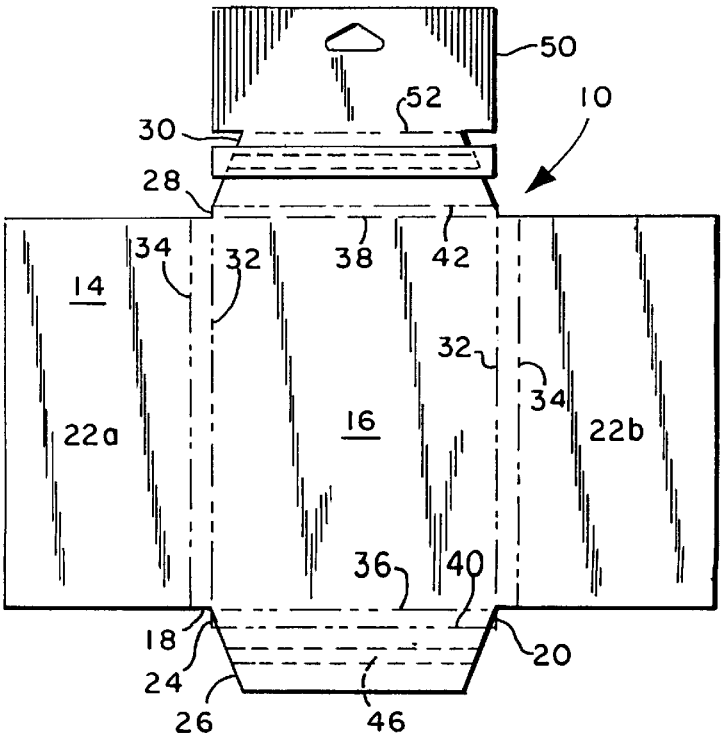
FIG. 4 is a plan view of the photo mailer seen in FIGS. 1–3 completely unfolded.

With reference to FIG. 4, photo mailer 10 comprises a front panel 16, a right side panel 18, a left side panel 20, a back panel 22, a bottom panel 24, a bottom flap 26, a top panel 28, and a top flap 30. FIG. 4 shows the back of the unfolded photo mailer 10 hence the right and left side panels are reversed. The back panel 22 is comprised of a right side back flap 22*a* and a left side back flap 22*b*. The right side back flap 22*a* extends from the right side panel 18 and the left side back flap 22*b* extends from the left side panel 20. As seen in FIG. 2, the right side back flap 22*a* extends over the left side back flap 22*b* and is adhesively bound to it in the finished product. The photo mailer is scored along lines 32 separating the right side panel 18 and the left side panel 20 from the front panel 16. The photo mailer 10 is also scored along lines 34 separating the right side panel 18 and the left side panel 20 from the right side back flap 22*a* and the left side back flap 22*b* respectively. This assures that the folding operation results in a crisp appearance of the finished photo mailer.

Figure 1:
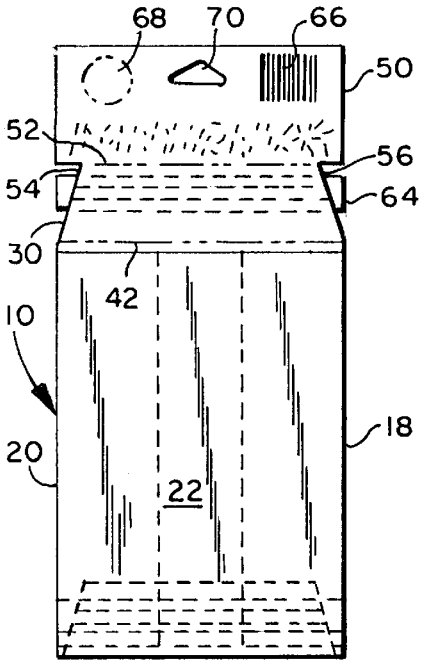
FIG. 1 is a plan view of the front of a photo mailer in accordance with a first embodiment of the invention.

Similarly, a score line 36 separates the front panel 16 from the bottom panel 24 and a score line 38 separates the front panel 16 from the top panel 28. A score line 40 separates the bottom panel 24 from the bottom flap 26 and a score line 42 separates the top panel 28 from the top flap 30. A band of adhesive 46 is applied to the bottom flap 26 allowing the bottom flap 26 to be adhesively bound to the back flap 22 as seen in FIG. 1. The score lines 36, 40 assure that the bottom panel 24 folds neatly and generally provides a flat surface perpendicular to the front panel 16 and the back panel 22 in the finished product.

As best seen in FIG. 1, the top flap 30 is connected to the merchandiser panel 50 at a perforated line 52. The top flap 30 has side edges 54, 56 which taper from the full width of the front panel 22 at the bottom of the top flap to a substantially reduced width at the perforated line 52 forming the top of the top flap. A band of adhesive 62 is applied to the Kraft paper surface 14 of the top flap 30. A parting sheet 64 is applied over the adhesive 62, protecting it. As can be seen in FIGS. 1 and 2, the parting sheet 64 is about equal in width to the width of the front panel 16 but somewhat wider than the tapered sides of the top flap 54, 56. This allows for ease of removal of the parting sheeting 64 without increasing the overall width of the photo mailer 10 as merchandised.

The merchandiser panel 50 is rectangular in shape and has a width equal to the width of the front panel 16 of the mailer 10 the finished surface 12 and the kraft paper surface 14 of the merchandiser panel 50 contain all merchandising information required or desired in the sale of the photo mailer product 10. Thus, the Universal Product Code bar code 66 appears on the merchandiser panel 50. A trademark or trade name 68 identifying the source of the photo mailer product 10 appears on the front surface of the merchandiser panel 50. Additional product information, such as the name of the distributor, the product identification, the country of origin, the price, and whatever else is desired or required can appear on the front or back of the merchandiser panel 50 as required and desired.

Figure 9:
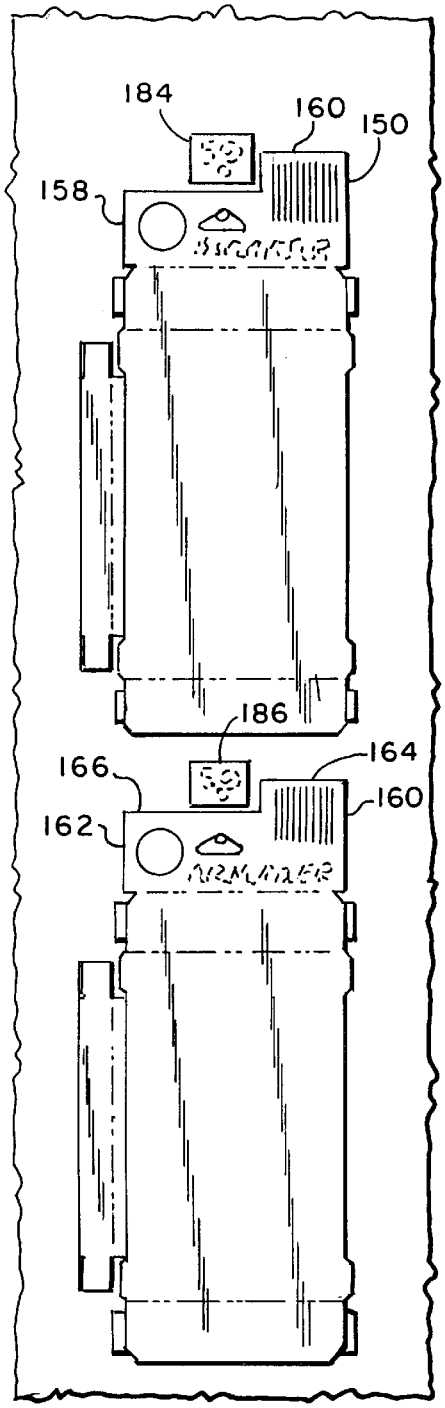
FIG. 9 is a plan view of a number of the compact disc mailers seen in FIGS. 5–8 as displayed at retail; and, FIG. 10 is a side view of a number of compact disc mailers displayed at retail seen in FIG. 9.
Figure 10:
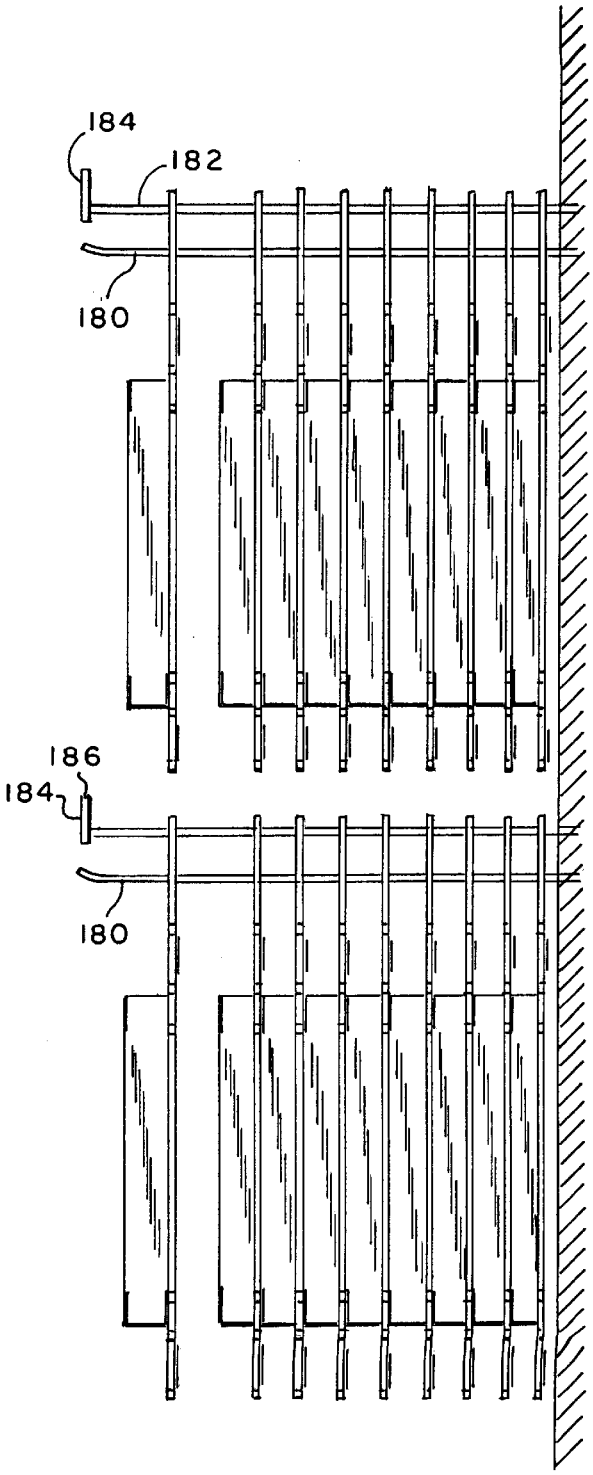

A hole 70 is provided near the top center of the merchandiser panel 50. This allows presentation of the photo mailer product on conventional peg sets as seen in many retailers (FIGS. 9 and 10).

The tapered nature of the top flap sides 54, 56 provides several advantages. It allows the parting sheet 64 to extend slightly beyond the top flap sides 54, 56 without being the wider of the front panel 16. It provides notches 72, 74 at the point where the top flap 30 joins the merchandiser panel 50. This allows a straight scored and perforated line 52 to separate these two panels while also providing a starting point for the consumer to cleanly tear the merchandiser panel 50 from the top flap 30 when he or she wishes to use the product. This also provides a margin for error should the consumer not have the package 100% square when the parting strip 64 is removed, the top flap 30 folded over and adhered to the back panel 20 in use of the product. If there is a slight misalignment, it will not detract from the overall appearance of the product.

The photo mailer 10 thus can be printed with gift wrap like patterns, mailing patterns or any other product marking desired by consumers. It need carry no merchandising information or product identification information whatever other than on the separable merchandiser panel 50. All this information can be carried on the merchandiser panel 50 thus providing an attractive product without the need for separate packaging. The merchandiser panel 50 is easily and cleanly separable from the photo mailer top flap 30 along the perforated line 52 and the separation is eased by the notches 72, 74. Once separated, the consumer can put photos or other objects in the photo mailer tab, remove the parting sheet 64 and fold the top panel 28 and top flap 30 over, adhering the top flap 30 to the back panel 22, closing the mailer. An economical photo mailer product is thereby provided.

A second embodiment of the invention is shown in detail in FIGS. 5–10.

A compact disc mailer 110 is fabricated from a single piece of corrugated cardboard. The unfolded but cut piece of cardboard is shown in plan view in FIG. 8. Like the photo mailer of the first embodiment, the compact disc mailer 110 is fabricated from a piece of corrugated cardboard having a kraft paper surface 114 on one side and a finished surface 112 on the other side. When the compact disc mailer is assembled into the product configuration, the finished surface 112 is the exterior surface while the kraft paper surface 114 will be the inside of the box shape. Referring again to FIG. 8, a front panel 116 is connected at a score line to a right side panel 118 which is in turn connected to a back panel 122. The back panel is connected to a left side panel 120 which is in turn connected to a left side panel flap 120*a*. Vertical score lines 132 separate each of the panels one from the other and allow for precise folding of the panels to form a boxlike shape with the finished surface of the left side panel flap 120*a* adhesively bound to the Kraft paper surface of the front panel 116 providing the configuration seen in FIGS. 5, 6 and 7. Horizontal score lines 134 are provided at the top and bottom of the front panel 116, the right side panel 118, the left side panel 120, and the back panel 122. The horizontal score lines 134 are continuing and straight and separate these panels from top and bottom panels and flaps. The back panel 122 is connected to a back panel top flap 122*a* and a back panel bottom flap 122*b*. The right side panel 118 is connected to a right side panel top flap 118*a* and a right side panel bottom flap 118*b*. The left side panel 120 is connected to a left side panel top flap 120*b* and a left side panel bottom flap 120*c*. The front panel 116 is connected to a bottom panel 124 which is in turn connected to a bottom flap 126. The front panel 116 is also connected to a top panel 128 which is in turn connected to a top flap 130. Horizontal score lines 136 separate the bottom panel 124 from the bottom flap 126 and the top panel 128 from the top flap 130 respectively. A merchandiser panel 150 is connected to the top flap 130 at a line 152 which is both scored and perforated. As can be best seen in FIG. 6, bands of adhesive 162 are applied to the kraft paper surface of the top flap 130 and the bottom flap 126. These bands of adhesive are protected by parting sheets 164. The top flap sides 154, 156 are comprised of lower vertical portions 154*a*, 156*a* and upper inwardly tapered portions 154*b*, 156*b*. The merchandiser panel 150 has a width equal to the distance between the vertical portions 154*a*, 156*a* of the top flap sides. Thus, the inwardly tapered portions 154*b*, 156*b* create notches, 172, 174 between the top flap 130 and the merchandiser panel 50 which lead to the perforated line 152. As is the case with the first embodiment, the notches 172, 174 make it easy for a consumer to separate the merchandiser panel 150 from the remaining portions of the compact disc mailer 110 for final use. The merchandiser panel 150 has a hole 170 allowing placement of the product for sale by retailers on a metal rod 180. It is conventional in retailing to provide rods in pairs on vertical surfaces for the display of products. The lower rod 180 supports the product by passing through holes 170 in the product itself or the product packaging. An upper rod 182 is spaced a standard small distance above the lower rod 180. The upper rod carries only a small rectangular panel 184 bearing a bar code and stocking information. This tells the retailer what should be stocked at this location. Should all of a particular product be sold, the retailer knows which item to restock by reading the bar code or the printed material on the rectangular panel 184.

The merchandiser panel 150 includes space for a trademark 168 and a UPC bar code 166. The merchandiser panel 150 is not rectangular. Rather, it is comprised of a first rectangular area 158 which is as wide as the front panel of the compact disc mailer 110. A second rectangular area 160 extends upwardly from the first rectangular 158. The second rectangular area 160 is less than half the width of the first rectangular 158. The second rectangular area 160 extends from one side only of the first rectangular area 158. As can be seen in the top half of FIG. 9, this allows the second rectangular area to extend upwardly beside the rectangular panel 184 at the end of the upper rod 182. This provides additional space for merchandising information on the merchandiser panel 150. While only a single upwardly extending rectangular area 160 is shown in the top half of FIG. 9, one could have a matching rectangular area 162 on the other side of the merchandiser panel 150 providing even more merchandising information area as shown in the bottom half of FIGS. 9 and 10. The two rectangular areas extend vertically so their top edges 164,166 are parallel to the top edge 186 of the rectangular panel 184, providing maximum merchandising area.

As can be seen in FIG. 9 and FIG. 10, compact disc mailers 110 are stocked to a depth of several units on the metal rod 180. Moreover, succeeding metal rods, one above the other, displaying additional products are packed closely together. This is also true in the lateral directions. Retailers need to present as many products as they can in limited area. By extending the merchandising information area into the second rectangular area 160 and third rectangular area 162, the vertical dimension of the first rectangular area 158 can be minimized and larger products or more products displayed in the same area. Space utilization is increased by several percent. This adds to the profitability of retailers.

Additionally, the compact disc mailer is sold as an individual product with both the bottom and the top opened as shown in FIGS. 5, 6 and 7. This allows the product to be sold in the partially collapsed state with the side panels 118, 120 not being perpendicular to the front panel 116. The overall thickness of the compact disc mailer is thereby reduced and a larger number may be displayed on a given depth of rod 180. As with the photo mailer 10, the compact disc mailer 110 is bought as a product by the consumer and the merchandiser panel 150 is removed by the consumer leaving all merchandising information off the product as used. The finished product can therefore be printed with appropriate mailing forms or printed as a gift box with none of the product retailing information left on the product. The consumer merely removes the merchandiser panel starting at the notches 172, 174 and following the perforated line 152. A compact disc in its jewel box is inserted into the compact disc mailer 110 and the flaps on the top and bottom of the mailer folded into appropriate position and adhered with the adhesive provided. A single compact disc mailer may thus be economically retailed and purchased by consumers without the added cost of external packaging.

The invention has been described with reference to preferred embodiments. Obviously, modifications and alterations will occur to others upon the reading and understanding of this specification and it is intended to include such modifications and alterations insofar as they come within the scope of the appended claims or the equivalents thereof.

Having thus described the invention, it is so claimed:

1. A box product comprising a unitary sheet divided into:

a front panel;

a right side panel;

a left side panel generally identical in size and shape to said right side panel;

a back panel generally identical in size and shape to said front panel;

a bottom panel extending from a first panel selected from said front panel and said back panel;

a bottom flap extending from said bottom panel adapted to be attached to a second panel selected from said front panel and said back panel;

a top panel extending from one of said first panel and said second panel;

a top flap extending from said top panel and having a band of adhesive, said top flap and said band of adhesive are adapted to be attached to the other of said first panel and said second panel; and, a merchandiser panel extending from said top flap and separable from said top flap at a straight scored and perforated line, wherein said top flap is tapered over at least a portion of its height creating notches adjacent said merchandiser panel, said merchandiser panel bearing all product indicia, all distributor indicia, and all Universal Product Code bar codes, such that said merchandiser panel is the only panel of said unitary sheet including at least one of said product indicia, said distributor indicia and said bar codes.

* * * * *